United States Patent [19]

Eberhardt

[11] 3,992,621

[45] Nov. 16, 1976

[54] FAST TRIPLANAR DETECTOR WITH COAXIAL CONNECTOR OUTPUT

[75] Inventor: Edward H. Eberhardt, Fort Wayne, Ind.

[73] Assignee: International Telephone and Telegraph Corporation, Nutley, N.J.

[22] Filed: Oct. 23, 1975

[21] Appl. No.: 625,291

[52] U.S. Cl. ..... 250/207; 313/94

[51] Int. Cl.[2] ..... H01J 39/12

[58] Field of Search ..... 250/211 R, 213 ST, 207; 313/94, 95, 318, 150

[56] References Cited

UNITED STATES PATENTS

| | | | |
|---|---|---|---|
| 3,378,714 | 4/1968 | Guyot et al. | 250/213 VT |
| 3,784,831 | 1/1974 | Reif | 250/213 VT |
| 3,887,810 | 6/1975 | Skaggs | 250/213 VT |

*Primary Examiner*—Alfred E. Smith
*Assistant Examiner*—David K. Moore
*Attorney, Agent, or Firm*—John T. O'Halloran; Thomas M. Marshall

[57] ABSTRACT

A vacuum tube photodetector includes a planar photocathode, a parallel high voltage accelerating mesh, and a planar output anode positioned adjacent to and spaced from the mesh. The anode and mesh are connected to the inner and outer concentric conductors of a high frequency coaxial transmission line coupled to a load or output device. The high voltage preacceleration of electrons by the mesh and the small mesh to anode spacing provide a significant reduction of electron transit or pulse rise time compared with known two element biplanar photodiodes. In addition, the vacuum seal between the anode and mesh is positioned adjacent the anode-mesh gap which greatly reduces pulse decay time and undesired reflections. The mesh and anode are at the same potential to eliminate the usual high bias voltage between inner and outer coaxial photocathode and anode electrodes of the biplanar tube, as well as a coaxial coupling capacitor.

7 Claims, 2 Drawing Figures

FAST TRIPLANAR DETECTOR WITH COAXIAL CONNECTOR OUTPUT

BACKGROUND OF THE INVENTION

1. Field of the Invention

This invention relates to photodetectors and particularly to an improved detector having an extremely fast response to light pulses.

2. Description of the Prior Art

Present biplanar coaxial photodiodes utilize a transparent anode mesh on the tube faceplate and a parallel photocathode spaced from the anode with an accelerating potential of about 2 to 5 Kv across the gap. Use of higher electric field gradients is limited, since higher potentials cause breakdowns. The photocathode electron emissive coating is spaced from the faceplate to reflect electrons toward the anode. This avoids a voltage drop which would occur as a result of the series resistance of the coating if it were disposed on the faceplate in the direct path of light passing through. Where the finite resistance of the photocathode is not a problem, the coating may be disposed on the input faceplate and the anode spaced therefrom. The photocathode of the biplanar tube provides the inner conductor of a high frequency coaxial output transmission line and the anode provides the outer concentric tubular conductor. An example of such a prior art tube is found in an article in the Journal of Physics and Scientific Instruments, Vol. 8, 1975, printed in Great Britain, entitled "Temporal response and real time measurements with a 5 GHz photocell-oscilloscope system at low light levels", by B. Sipp et al.

The tube response time to light pulses is limited by the voltage and the relatively large gap between the anode and photocathode. In addition, a high voltage capacitor is normally required in series with the photocathode inner coaxial line to block the high voltage from the low impedance instruments or amplifiers that are coupled as a load to the output of the phototube. This capacitor causes additional difficulties with undesired oscillations or ringing losses, and possible breakdown. There are also problems with the vacuum seal which is spaced along the line from the photocathode-anode gap and causes relatively slow decay time, impedance mismatch, and pulse reflections.

SUMMARY OF THE INVENTION

It is therefore the primary object of the present invention to provide an improved simplified fast response photodiode structure which reduces pulse rise and decay times and undesired reflections, and eliminates the use of a high bias voltage and a series blocking capacitor in the output coaxial line.

This is achieved by a novel triplanar vacuum tube structure including a planar photocathode receiving the light input pulses and emitting electrons, a parallel high voltage accelerating mesh, and an adjacent closely spaced planar anode at the same potential as the mesh. The anode is connected to one conductor of a coaxial line and the mesh is connected to the other concentric conductor providing an output line for connection to following instruments or amplifiers. The small gap between anode and mesh and large accelerating voltage between the photocathode and mesh provide reduced pulse rise time in response to input light pulses on the photocathode. Since the mesh and anode are at the same potential, no high voltage is present in the output line and no isolating capacitor is needed to block direct voltage to the following load. The vacuum seal between the coaxial anode and mesh is also positioned close to the gap to reduce decay time and undesired reflections. The invention will be more fully understood and become apparent from the following description in conjunction with the accompanying drawings.

DESCRIPTION OF THE PREFERRED EMBODIMENTS

Figure 1:
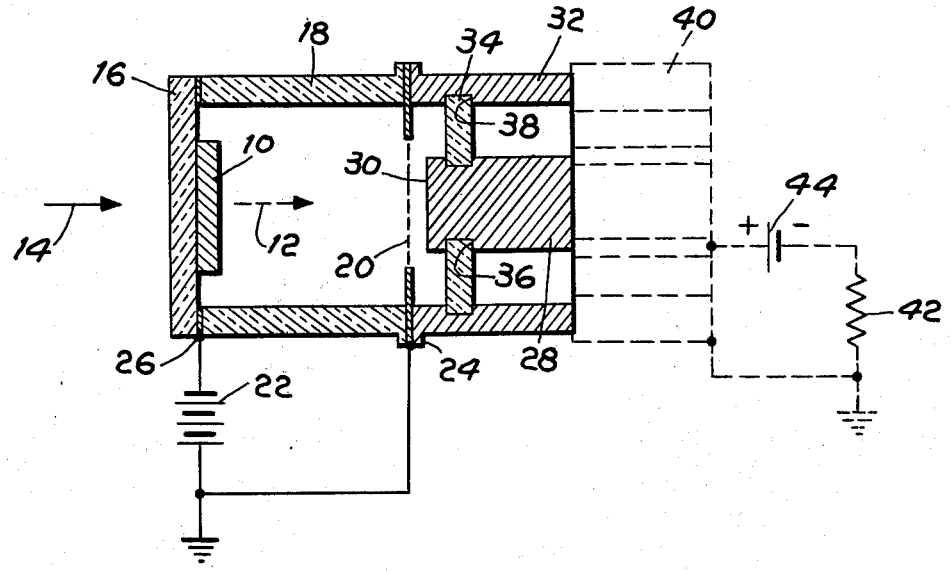
FIG. 1 schematically shows a cross-section of the triplanar phototube in accordance with the present invention.

As shown in FIG. 1, a planar photocathode layer 10, which emits electrons 12 when subjected to light 14 from an external radiation source, such as pulses from a laser beam, is disposed on the transparent input faceplate 16 of a cylindrical glass vacuum tube envelope 18. A parallel accelerating grid mesh 20, preferably of nickel or copper, is spaced from the photocathode in the path of electrons, with a high potential of about 5 to 10 Kv from a direct voltage source 22 applied between the mesh and the photocathode. The mesh is connected through a kovar-glass seal 24 in the outer envelope to ground potential and the photocathode is connected through an indium seal 26 at the faceplate to the negative high voltage terminal. Output anode 28, which is at the same high potential as the mesh, has a smaller diameter planar surface 30 which is positioned in close proximity to the mesh to receive electrons passing through mesh 20. The anode, which may be of stainless steel and either solid or hollow, provides the central inner axial conductor of an output coaxial line. The coaxial line includes a concentric hollow outer tubular conductor 32, also of stainless steel, which is connected to the mesh 20 and sealed to glass envelope 18 at seal 24. The coaxial line presents a low output impedance of about 50–100 ohms to high frequency signals to permit connection to low impedance instruments or amplifiers without mismatch and undesired reflections. A sealing ring 34 of a suitable ceramic material provides a vacuum tight seal between the inner anode and outer tubular conductor 32. The seal is positioned adjacent the edge of the anode at or close to the gap between the mesh and anode to reduce pulse decay time and undesired ringing and oscillations. Any reflections of electromagnetic energy at the seal occur and decay rapidly. The slots 36, 38 in the anode and outer coaxial tube around the seal, and the distance of the slots from the gap, provide a selected impedance match to reduce losses of microwave pulses through the seal. The ratio of inner and outer diameters of the coaxial conductors also determines the impedance match.

By placing the photocathode on the faceplate out of the transmission line, and by placing the mesh and anode at the same high potential and at a close spacing, a significant reduction of pulse rise time and faster response is obtained. The rise time is a function of the gap spacing and potential applied. As an example, in the known biplanar tube, the approximate rise time for electrons to cross a gap between anode and cathode of about 6 mm, at 2,500 volts, is about 0.4 – 0.5 nanoseconds. In the present tube there is a gap of 1 mm between the mesh and anode and a pre-accelerating voltage applied between mesh and photocathode of about 10,000 volts. These values are possible since the mesh and anode are at the same potential to permit use of a small gap therebetween, while the mesh-photocathode gap and potential can be made much higher. Voltages of from two to ten times that of the biplanar tube type can be used. A typical rise time is the about 17 picoseconds, or some 25 times faster than the standard biplanar tube.

No output pulse is generated in the relatively long time interval when photo-electrons from the photocathode are accelerated to final velocity. Only when the electrons are fully accelerated do they cross the mesh-anode gap to produce an output pulse. The mesh effectively shields the anode from any signal induced between the cathode and mesh. There is a slight loss of sensitivity due to loss of some electrons at the mesh, but this is minimized by use of a high transmission mesh which is about 85 percent open, such as used for the anode in the known biplanar tubes. The mesh spacing from the anode is preferably from 5 to 25 percent of the overall spacing between anode and photocathode and is in the order of from 0.1 to 1 mm. The anode diameter may be from four to five times the spacing from the mesh. The mesh spacing is selected to meet the desired pulse response and has a minimum determined by manufacturing tolerances.

Since there is no direct voltage required between the mesh and anode, no fast coupling high voltage capacitor is required to isolate the direct voltage from the following low impedance termination such as amplifiers or instruments. This eliminates problems caused by the capacitor such as voltage breakdown and undesired oscillations. The inner and outer conductors 28, 32 are connected through a standard coaxial connector 40 and cable to a resistive load 42, as shown in dotted lines. This value is typically about 50 – 100 ohms, which represents the impedance of the associated amplifiers or output device circuits. A small D.C. bias voltage 44 of from 10 – 100 volts may be necessary to suppress secondary electrons emitted from the mesh or anode, but this small bias voltage can readily be applied through conventional low voltage capacitors in series with the load. The connection of the anode to ground is made through the small load resistor, and small bias source when necessary, so that the voltage is substantially the same as on the mesh.

The positioning of the vacuum sealing ring 30 close to the mesh-anode gap causes any reflections to occur rapidly within a few picoseconds of the initial pulse. This minimizes the effect on the output pulse and reduces decay time. The sealing ring may also be used as an impedance matching terminating resistor. Maximum rise and fall times should be about 10 – 20 picoseconds.

Figure 2:
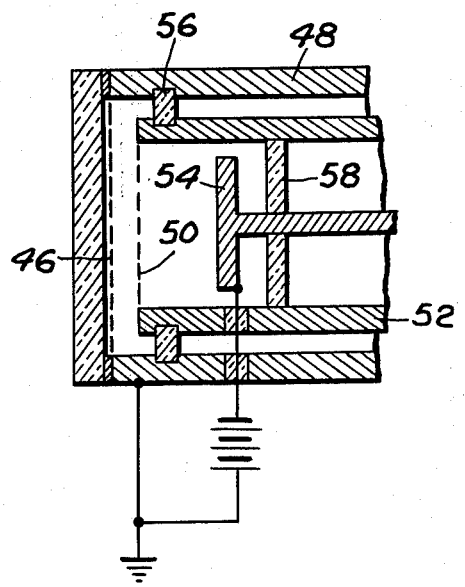
FIG. 2 shows another variation having a reversed polarity voltage and relation between anode and photocathode.

If the impedance of the translucent photocathode on the faceplate is a limiting factor, a reversed triplanar structure can be used, such as shown schematically in FIG. 2. In this case, the input window will have an anode mesh 46 connected to the outer tubular coaxial conductor 48, with a closely spaced accelerating mesh 50 connected to the inner coaxial electrode 52. A reflective metallic photocathode 54 is at a higher negative potential. The sealing ring 56 is again positioned close to the anode-mesh gap between inner and outer coaxial conductors. The photocathode is now a central electrode which again does not form part of the coaxial transmission line. A second seal 58 is required to complete the vacuum seal around the photocathode.

The present invention thus provides an improved simplified fast response photodetector. While several embodiments have been illustrated and described, it is apparent that other variations may be made in the particular design and configuration without departing from the scope of the invention as set forth in the appended claims.

What is claimed is:

1. A radiation sensitive detector comprising:

means for emitting electrons in response to radiation, means for accelerating said electrons, means for collecting said accelerated electrons, said accelerating means being positioned closer to said collecting means than to said emitting means, means applying an electron accelerating potential between said accelerating means and said electron emissive means, said collector and accelerating means being at substantially the same potential, and wherein when each of said emitting means accelerating means and collecting means are planar and parallel, and a coaxial output connector having inner and outer concentric conductors for connection to a coaxial line, said accelerating means including a mesh electrode connected to one of said conductors, and said collecting means including an anode connected to the other conductor.

2. The device of claim 1 including a vacuum tight envelope enclosing said electron emissive means, accelerating means, and collecting means, and means providing a vacuum tight seal between said coaxial conductors, said seal being positioned adjacent the space between said accelerating mesh and collecting means.

3. The device of claim 2 including a faceplate at one end of said detector, said electron emissive means being disposed on said faceplate, said anode being connected as the inner conductor of said coaxial line and said mesh being connected as the outer conductor of said line.

4. The device of claim 2 including a faceplate at one end of said detector, said anode being disposed on said faceplate and connected as the outer electrode of said coaxial line, said mesh being connected as the inner electrode of said line, and said electron emissive means being spaced from said faceplate.

5. The device of claim 2 wherein said mesh is spaced from said anode at a distance of from 5 to 25 percent of the distance between said anode and said electron emissive means.

6. The device of claim 5 including means for coupling said coaxial conductors to an output load, and means for matching impedance of said coaxial conductors to said output load.

7. The device of claim 6 including bias means connected between said anode and mesh for suppressing secondary electron emission from said anode.

* * * * *